US005321926A

United States Patent [19]

Kennedy

[11] Patent Number: 5,321,926

[45] Date of Patent: Jun. 21, 1994

[54] BUILDING BLOCK

[76] Inventor: Francis A. Kennedy, 4540 Gentwood Dr., Williamsville, N.Y. 14221

[21] Appl. No.: 65,407

[22] Filed: May 24, 1993

[51] Int. Cl.[5] ..... E04B 2/00

[52] U.S. Cl. ..... 52/405.1; 52/570; 52/612

[58] Field of Search ..... 52/404, 405, 596, 444, 52/606, 396, 569, 570, 309.12

[56] References Cited

U.S. PATENT DOCUMENTS

| | | | |
|---|---|---|---|
| 2,275,523 | 3/1942 | Goldbeck | 52/396 X |
| 4,185,434 | 1/1980 | Jones | 52/405 |
| 4,856,248 | 8/1989 | Carson et al. | 52/405 |
| 4,986,048 | 1/1991 | McMarlin | 52/396 X |
| 5,066,440 | 11/1991 | Kennedy et al. | 52/405 X |

*Primary Examiner*—Carl D. Friedman
*Assistant Examiner*—Creighton Smith
*Attorney, Agent, or Firm*—James J. Ralabate

[57] ABSTRACT

A novel insulated cementitious building block is disclosed. This block has a substantially larger inside section or segment than the outside section or segment. Positioned between these two sections is a middle portion which houses the insulating material. The middle portion has a sinuous configuration thus holding more insulating material than a linear configuration. Griping holes which are compatible with conventional building blocks are provided which can act as conduits for electrical wires or the like. Also, these holes can later be filled with additional insulation to substantially enhance the insulating properties of the block.

9 Claims, 3 Drawing Sheets

Fig. 5
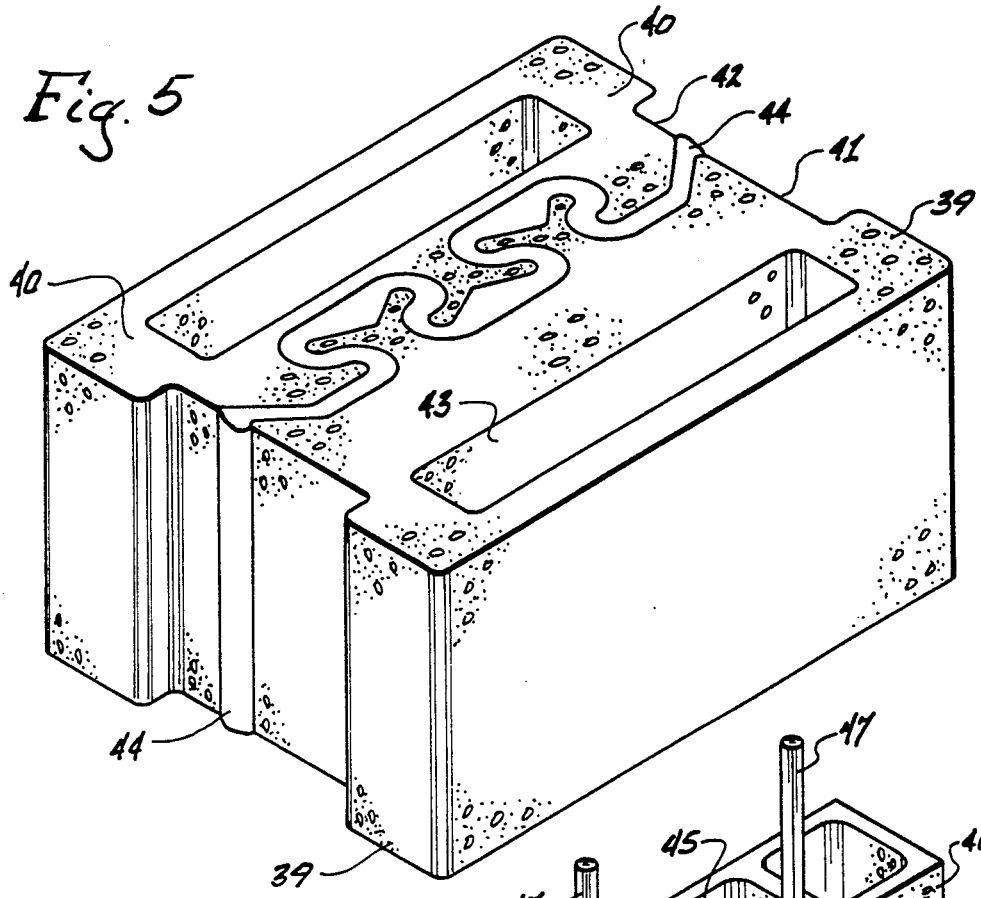
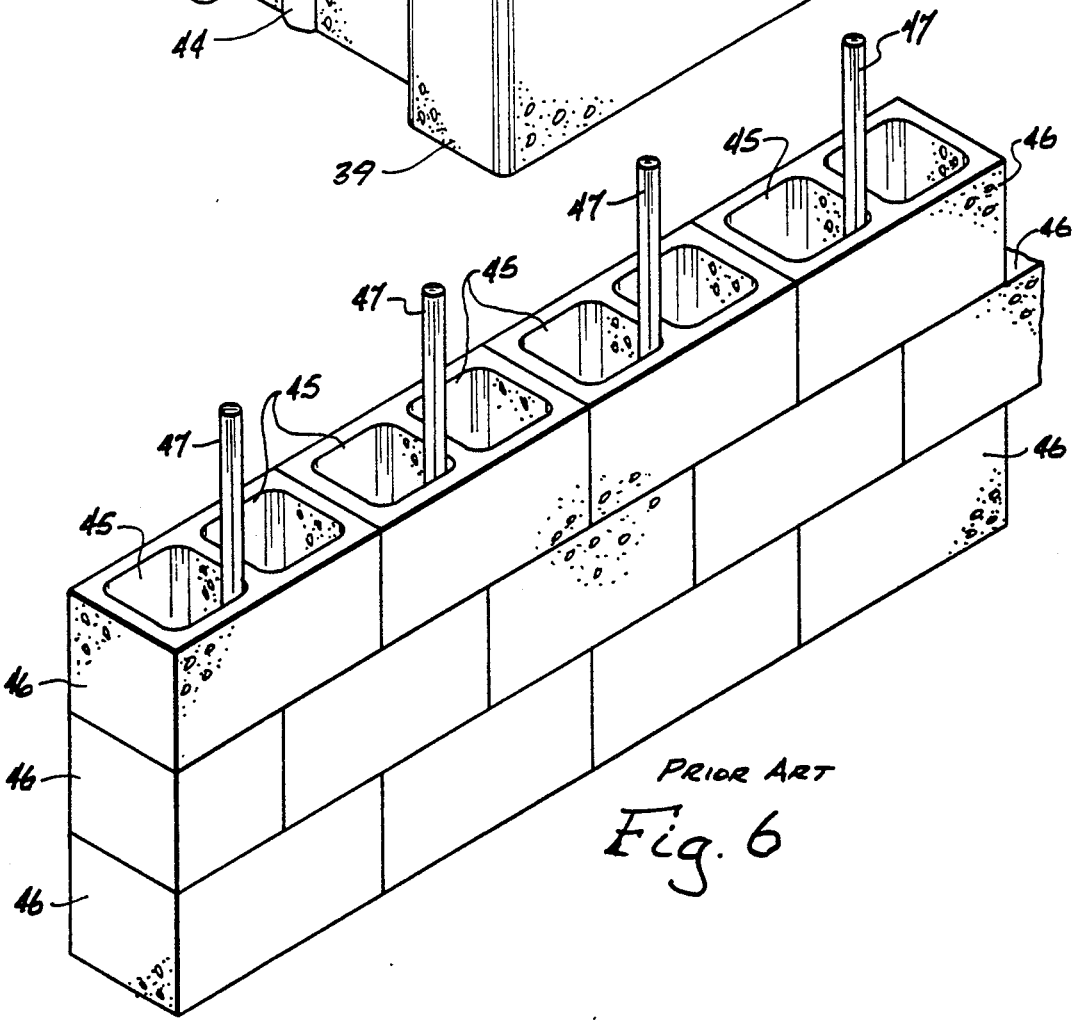
PRIOR ART
Fig. 6

BUILDING BLOCK

This invention relates to a building block and, more particularly, to a novel insulating building block having several improved features.

BACKGROUND OF THE INVENTION

There are known in the prior art several types of insulating cementitious building blocks such as those disclosed in U.S. Pat. Nos. 4,185,434; 4,551,959; 4,856,248; 4,986,049 and 5,066,440.

In U.S. Pat. No. 4,185,434 (Jones) the building block is formed from two block parts, one including the front wall of the block and one including the rear wall of the block. These two parts are maintained spaced apart by a layer of insulating material. There are internal "A" and smaller end cavities "B" in Jones' invention that are positioned so that when a plurality of blocks are placed in juxtaposition with each other to form a wall, the overall dimensions of adjacent cavities B are about the same as the dimensions of the cavities A. The cavities, corners and sections 4 and 5 all have squared or linear configurations which could cause the easy fracturing of the cementitious block when a strain is exerted thereon. Also, Jones' block does not have the appearance or feel of a conventional block and could present an unaccustomed structure for the mason to work with. In addition, main sections 4 and 5 are approximately the same size which could prevent obtaining maximum insulation properties as will later be explained.

In Schmid, U.S. Pat. No. 4,551,959, an insulating building block is described having two spaced supportive parts separated from one another by an insulating material. The block of Schmid is substantially solid with no griping holes or means for the mason or builder to work with when lifting and placing the block in position. In addition, the supportive parts 12 and 14 are substantially the same in size and configuration (column 3 lines 29–31). As above noted, maximum insulation properties are not provided when the inner or inside section of the block is the same size or smaller size than the outside section of the block. When the inside section has a larger mass or is of a greater size than the outside section, a significant improvement in insulating properties of the block can be realized. Also in Schmid, his projections 58 and 60 are smaller than the openings of the recesses surrounding these projections so that if the insulation 16 erodes away, sections 12 and 14 will easily separate and fall from each other.

In U.S. Pat. No. 4,856,248 (Larson) a building element or block is described having linear sections of varied densities. All sections of Larson are squared or have a linear configuration which could cause easy fracturing of portions of the block. Also, there are no grip holes in Larson's structure which would make it difficult for the mason to lift or place the blocks in position. Also, the sections of Larson identified by walls 80–82 and 90–92 are approximately the same size which does not provide maximum insulating properties of the block or building element.

In U.S. Pat. Nos. 4,986,049 and 5,066,440 (Kennedy et al) an improved building block is described having main sections 12 and 14 interlocked by T-shaped structures 34 and 36. Main sections 12 and 14 are approximately equal in size and do not provide any griping holes therein. Insulating portion 16 has thumb holes 154 which are intended to facilitate lifting of the blocks.

Conventional cement masonry blocks have substantially large griping holes which workers are accustomed to using. Also, these conventional large griping holes, in addition to facilitating lifting, also provide convenient conduits for accommodating wiring and providing an opening or openings for re-bars that are used to reinforce walls. Therefore, the absence of griping holes and the equal mass of inside and outside sections 12 and 14 are important drawbacks to Kennedy et al's structure.

Also, as suggested in the prior art, breaking away a portion of a block to accommodate re-bar or to provide space for reinforcing rods is cumbersome and could cause block fracturing. Fracturing of the block obviously would compromise the integrity and strength of the wall.

SUMMARY OF THE INVENTION

It is therefore an object of this invention to provide a building block devoid of the above-noted disadvantages.

Another object of this invention is to provide a building block having griping holes that workers are accustomed to using.

A further object of this invention is to provide an insulated building block that provides improved heat and sound insulating properties.

Yet a further object of this invention is to provide an insulating building block that is stronger and more structurally stable than heretofore used building blocks.

A yet further object of this invention is to provide an insulating building block that is easier to handle, more easily reinforced with re-bar and can easily accommodate wiring and additional insulation.

A still further object of this invention is to provide a building block having improved fire resistance properties.

These and other objects of the present invention are provided by a novel insulating building block having a three-section configuration. There is an outside segment which is generally used to face or form the outside of a building, there is an inside segment which is generally used to face or form the inside surface or walls of a building and a middle portion which connects the inside and outside segments together- Filled within this middle portion is an insulating material that has either or both thermal and sound insulating properties.

It is critical to the present invention that there be at least one but preferably two or more conventional type griper holes in the block; the type of griper holes skilled masons are accustomed to and can use comfortably. These griper holes must be internal of the block for best results and not on the outside portions of the block. They should mesh with conventional block when used therewith. It is also very important to the present invention that the inside segment of the blocks has a larger mass than the outside segment. This larger inside segment provides substantially better insulation because of its increased mass. The present invention combines insulation with a high mass inside segment so that once the inside segment or mass is heated or cooled it maintains its desired temperature for a longer period of time. This larger inner insulated thermal mass is the most energy efficient way of structuring an insulating building block. The sinuous configuration of the middle portion provides both a larger area of insulation and a convenient arrangement for positioning interlocking projections and openings of the segments.

The cement masonry unit (CMU) or building block of this invention is best described as a three-piece unit. The outside part or facade is made of a cementitious material and can have any number of finishes and it is load bearing. This facade is interlocked with the inside or inner load-bearing part of the building block by a serpentine configured middle part made of any suitable insulating material such as expanded polystyrene (EPS) or the like. The inner or inside load-bearing part is also made of a cementitious material and it is critical to the present invention that it contain the larger part of the mass of the block. This inner part is made to interlock with the other two parts of the unit, the insulating middle part and the front facade or outside segment.

As noted, the major most massive part of this CMU is the inner part or inside segment which is similar in design to that of a conventional building block made of various aggregates to achieve strength, lightness or both. There are preferably two holes in the inner part of this CMU which accommodate the mason or builder and enable this CMU to be handled and used in the same manner as conventional building blocks.

This CMU is as stable and strong as conventional CMUs and has the additional advantage of providing a large insulated mass which will retain the inner temperature of the structure. The insulating middle part gives the CMU a large inner insulated thermal mass which is lacking in a conventional CMU or the insulated building blocks earlier noted in prior art patents.

The HI-MASS (or HI-THERM) CMU of this invention is a vast improvement on existing structures used as insulating building blocks. The advantages of the insulating block of the present invention are: it is more structurally stable, it is stronger, easier to handle (preferably has the two-hole configuration of conventional blocks), it is more easily reinforced with re-bar (the two-holes can be utilized), it can easily accommodate wiring, conduit and additional concrete or insulating fill in these holes.

Re-Bar is a term used to define reinforced masonry wall construction. The procedures used in laying masonry units involve placing reinforcing bars and pouring grout that varies with the size of the job, the equipment available, and the preferences of the contractor.

Hollow concrete masonry units with grip holes should be laid so that their alignment of grip holes form an unobstructed, continuous series of vertical cores within the wall framework. Spaces in which reinforcement will be placed should be at least 2 inches wide. No grout space should be less than ¾ inch or more than 6 inches wide.

Two-core, or grip hole plain-end units are preferable to three-core or other units because the larger two cores or grip holes allow easier placement of reinforcing bars and grout. Also, these units are more easily aligned as with conventional blocks for their cores to form continuous, vertical spaces in which to place reinforcing bars.

The mortar bed under the first course of block should not fill the core area to be grouted because the grout must come into direct contact with the foundation. All head and bed joints should be filled solidly with mortar for the thickness of the face shell. With plain-end units, however, it is not necessary to fill the head joint across the full unit width. Also, when the wall is to be grouted intermittently, only the webs at the extremity of those cores containing grout are mortared. When the wall is to be solidly grouted, none of the cross webs need be motrated since it is desirable for the grout to flow laterally and form the bed joints at all web openings.

Vertical reinforcement may be erected before or after the masonry units are laid- When the reinforcing bars (re-bars) are placed before the units, the use of two-core or grip hole opened, A- or H-shaped units become desirable in order for the units to be threaded around the reinforcing steel. When the bars are placed after the units, adequate positioning devices are required to prevent displacement during grouting. Both vertical and horizontal reinforcement should be accurately positioned and rigidly secured at intervals by wire ties or spacing devices. The distance between reinforcement and the masonry unit or formed surface must not be less than ¼ inch for fine grout or ½ inch for coarse grout.

For this procedure of reinforcement to be utilized, aligned grip holes in each block are required. Prior art blocks without grip holes make it extremely difficult to reinforce the walls by re-bar (see FIG. 6 below).

The design of the present CMU makes it much easier for the builder to hang fasteners, hooks and apparatus on the wall and still the CMU is webless and has complete insulation from the outside facade. Most significant and critical to this invention is that this CMU insulates a major portion of its mass because the major portion of the mass is in the inner or inside part of the CMU insulated by the middle insulating part.

The whole idea of an insulated CMU is to combine insulation with high mass so that once the inner mass is heated or cooled it maintains its desired temperature for a longer period of time. This is Insulated Thermal Mass and is the most energy efficient way of maintaining a desired temperature. The temperature-retaining properties of a material are also referred to as Thermal Lag. This characteristic (Thermal Lag) of high mass materials aids the temperature control equipment of a building to maintain the desired state more easily thus using less energy.

Another advantageous feature of this HI-MASS CMU is its sound transmission blocking characteristic. This CMU diminishes the sound that can pass through a wall because its three-part structure causes sound waves to deteriorate in volume as they pass from one medium to another, first through the facade then through the middle insulating material and, finally, through the inner major mass part.

Still another advantage of the HI-MASS CMU is its superior fire resistance. Because the inner part contains the majority of the mass it will withstand high heat for a longer period than either conventional CMUs or existing patented structures.

The in-plant production of the block of this invention, i.e. HI-MASS CMU, will not be any more labor intensive than production of other insulated blocks. This unit will provide great design variety for the outside facade. For aesthetic purposes, the facade can be produced with any number of finishes, e.g. splitface, split fluted, scored, glazed, ground or burnished. In addition to the grip holes used in the block of the invention, thumb holes may be used, if desirable.

This CMU will easily combine with post-tensioning systems which are extensively used in Europe and are rapidly becoming accepted as a technique of building reinforcing in the United States.

This HI-MASS CMU can be made with several different aggregates from heavy dense cement and stone to lightweight exploded shale and pumice depending on the design requirements of a particular structure. Any of the known CMU manufacturing processes can be used in the present invention such as those disclosed in U.S. Pat. 4,986,049. Any suitable insulation may be used such as those defined in U.S. Pat. Nos. 4,185,434; 4,551,959; 4,856,248 and 4,986,049. Preferably, the block of the present invention is made by the procedure described in U.S. Pat. No. 5,066,440.

The middle insulating part can also be made of a variety of materials. These include but are not limited to expanded polyethelene, polyurethane resins, polystyrene resins, phenolic resins, formaldehyde resins and mixtures thereof. Heavy fire resistant foams and lead-lined materials for R.F. wave blocking or other suitable materials may also be used.

The versatility of the HI-MASS CMU of this invention is greater than previous units because of increased stability and load-bearing features which result from the high inner mass of the unit. All of these advantages are obtained by this design while maintaining the exterior dimensions of conventional CMUs and thus making the HI-MASS CMU interchangeable with conventional units.

BRIEF DESCRIPTION OF THE DRAWINGS

FIG. 5 is a top plan view of pilaster block embodiment of this invention.

FIG. 6 is a perspective view illustrating prior art re-bar reinforced masonry walls.

DESCRIPTION OF A DRAWINGS AND PREFERRED EMBODIMENTS

Figure 1:
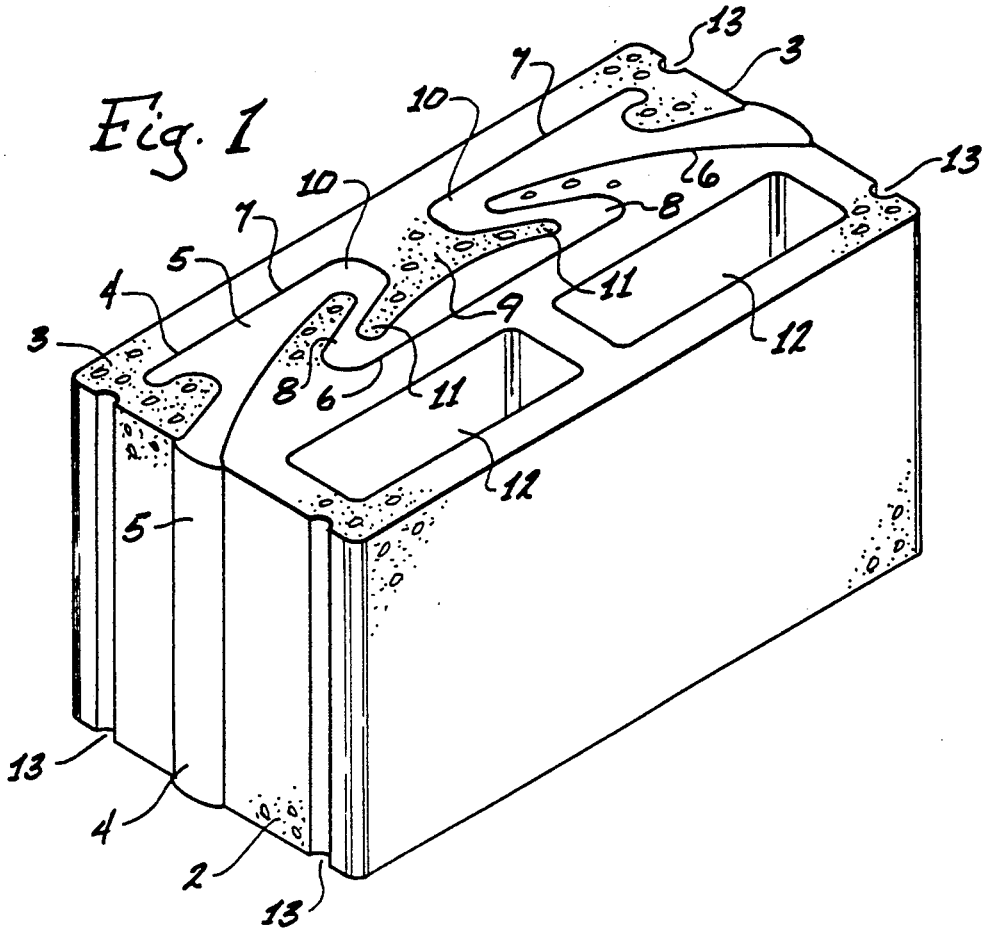
FIG. 1 is a top perspective view of a three-part building block structure of this invention.

In FIG. 1 a substantially rectangular building block 1 is illustrated having a three-component structure, an inner or inside segment 2 and outer or outside segment 3 and a middle portion 4. The middle portion 4 contains or is filled throughout its area with an insulation material 5 which acts as the insulation means for this block structure and also holds segments 2 and 3 together. As earlier noted, any suitable insulating material 5 may be used such as polymeric foams known in the art. In making the block 1, segments 2 and 3 are arranged with their inside surfaces 6 and 8 facing each other in spaced relationship, leaving the desired space into which the insulation 5 will be deposited, sprayed or otherwise positioned. After the insulation 5 is allowed to cure or harden, segments 2 and 3 are adhered together thereby. Inside surface 6 in FIG. 1 has a central receiving opening 8 which receives and locks with dovetail or inverted T-shaped projection 9. Opening 8 has an entrance opening 10 which is smaller than the horizontal dimensions of large section 11 of projection 9. This is important to laterally interlock or to hold sections or segments 2 and 3 together should insulation 5 ever fall away or be dislodged from middle portion 4. Any number of projections 9 and receiving openings 8 may be used depending upon the desired result. It will be noted that all portions of block 1 have curved surfaces to minimize fracturing of the block. It is not uncommon for the block 1 before use to be moved where stresses are exerted upon it. Blocks with linear portions will have a tendency to be more easily fractured upon the application of stresses thereon. A critical feature of this invention is to provide an insulating building block having the inside segment 2 substantially larger than outside segment 3. This feature provides maximum insulation properties since a large insulated mass 2 facing the inside wall of a building will retain the inner temperature of the building longer. The purpose of an insulating block is to insulate the interior of a building or structure- Providing a greater thermal or acoustical mass at the inner side of the block provides this benefit. The serpentine structure of the insulation 5 and middle portion 4 allows a greater amount of insulation to be used than would a straight line middle portion. In addition, fracturing of the block parts is minimized as earlier noted- Another critical feature of this invention is providing grip holes 12 in building block 1. Masons and other builders are used to handling cement blocks with grip holes 12 rather than solid or thumb holes or other openings suggested by the prior art. In addition, the block 1 of this invention provides grip holes 12 that are easily reinforced with re-bar and can better accommodate wiring and other items which require through conduits. The solid blocks or thumb hole blocks of the prior art do not provide these convenient in-the-wall conduits. In addition, after installation, additional insulation 5 can be filled into these grip holes 12 to give additional insulation properties to the block 1. Also, grip holes 12 make it more convenient for the builder to hang fasteners, hooks and other apparatus on the wall. The supporting segments 2 and 3, because of their configuration, provide the strength of conventional blocks and have the additional advantage of allowing near maximum insulation to the building or structure. The rigidity and insulation of block 1 are significantly increased additionally by the addition of more insulation 5 to the interior of grip holes 12. While two grip holes 12 are preferred because of conformity and use with conventional blocks, any desired number of grip holes may be used. Also, it is highly preferred to provide the side portions of block 1 with mortar grooves 13 for improved adhesion to adjacent blocks in the wall structure. The block 1 of this invention, because of its conventional size and because it provides grip holes 12 can be conveniently used together with conventional two-hole blocks used often in the building trade.

Figure 2:
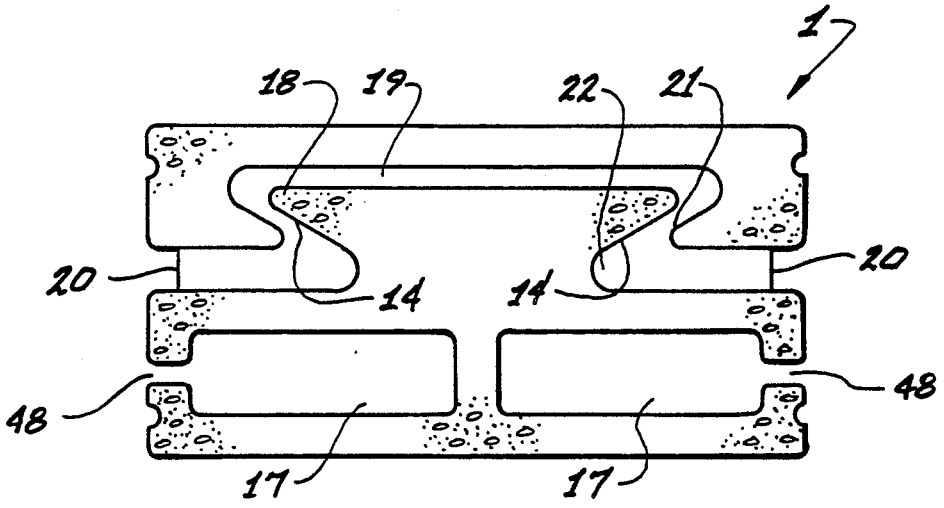
FIG. 2 is a top plan view of a second embodiment of a three-part building block structure of this invention.

In FIG. 2 the dovetail-like projection 14 is provided in the larger inside segment 15 rather than in smaller outside segment 16. The grip holes 17 are provided in segment 15 as in FIG. 1, however they may optionally be located in outside segment 16. In the embodiment of FIG. 2 slot channels 48 are shown which permit the bars 47 (of FIG. 6) to slide via slots 48 inside the grip holes 17. When the mason is laying the blocks for the wall, with the slots 48 provided, he does not have to lift the block 1 above the bars 47 for the bars 47 to fit into grip holes 17. At least one slot 48 should be used in this embodiment in each block. However, if desirable, one slot 48 per grip hole 17 may be used as illustrated in this figure. The slot 48 extends the entire height or thickness of the block 1 in order to permit bar 47 access to the interior of the grip holes 17. It is preferred to position grip holes in the larger inside segment 15 for structural stability of block 1. The projection 14 has a largest section 18 which extends beyond the entrance 22 of receiving opening 19 to thereby laterally lock pieces or segments 15 and 16 together even when and if insulation 20 falls away from middle portion 21.

Figure 3:
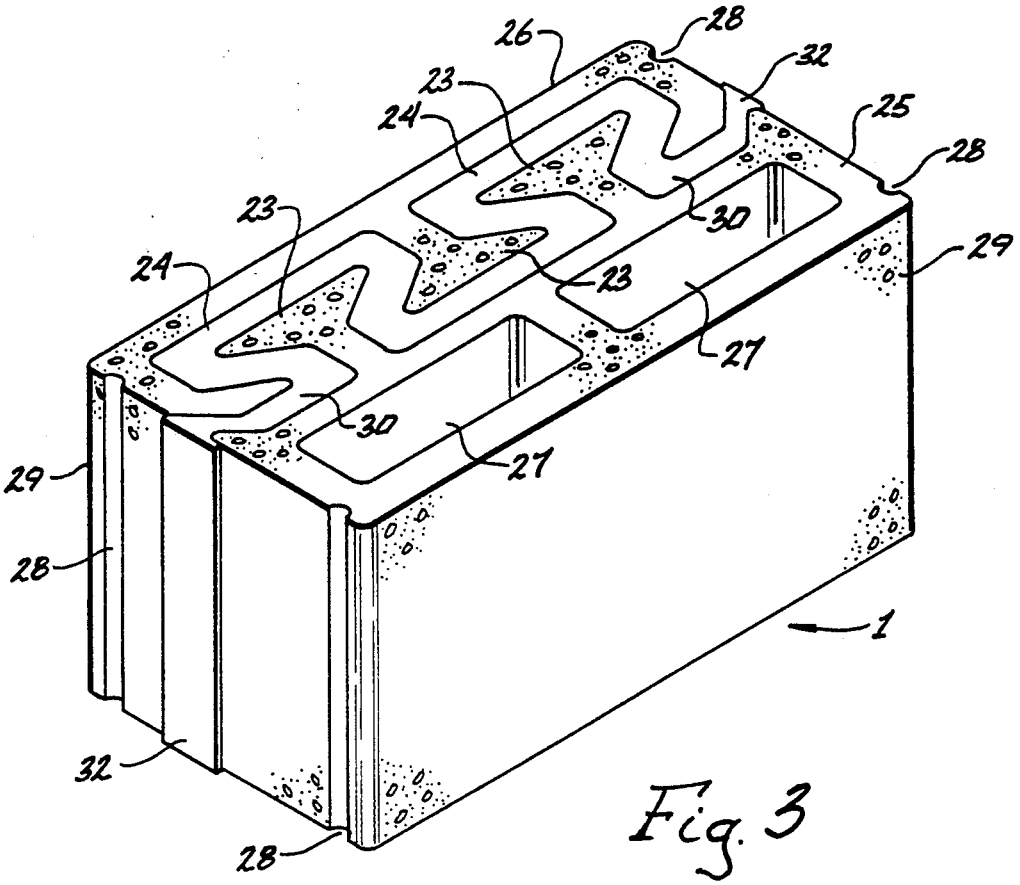
FIG. 3 is a top perspective view of another embodiment of this invention.

In FIG. 3 block 1 has multiple projections 23 all interlocking with alternate receiving openings 24 to lock segments 25 and 26 together. In all figures the two critical features of this invention are present, i.e. a larger inside segment 25 (than outside segment 26) and grip holes 27 of a conventional nature so as to be compatible with commonly-used cinder or cementitious building blocks. Another important feature is mortar slots 28 which are located in the corner portions 29 of each block (of all figures) to facilitate better connections to adjacent blocks. Insulation 30 fills substantially the entire middle portion 31 and extends out at 32 beyond the terminal side portions of segments 25 and 26. All of the faces, sides and structures of block 1 of this invention are curved to avoid fracturing as noted earlier.

Figure 4:
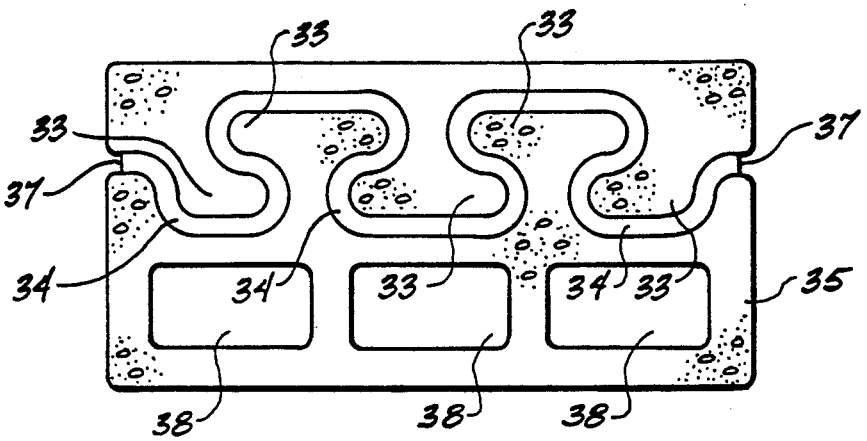
FIG. 4 is a top plan view of a fourth embodiment of this invention.

In FIG. 4 a top plan view of another embodiment of the block of this invention is illustrated. In this figure there are a plurality of projections 33 which fit into receiving openings 34. The size and dimensions of inside segment 35 are larger (as in all other figures) than outside segment 36. More than two griping apertures 38 are illustrated in FIG. 4 since any desirable number may be used. However, it is preferred for compatibility with other conventional blocks that only two griping apertures 38 be used. Also, in FIG. 4 insulation 37 is recessed into rather than extending out from the side portions of block 1. This is an alternative to extending the insulating layer 37 beyond the sides of segments 35 and 36. After the blocks are set next to each other, insulation is put in the gap formed by recesses to fill them in to effectuate a solid continuous insulation section.

In FIG. 5 a top plan view of a pilaster block embodiment of this invention is illustrated. This pilaster block is used for reinforcing large or tall wall sections and can be used for 8, 10 or 12 inch blocks. In this figure sections 39 and 40 extend out from inside segments 41 and outside segment 42, respectively. Also, one relatively large grip hole 43 is located in segment 41 which could be compatible with conventional two-hole blocks because of overlapping or extending portions of hole 43. An advantage of using the embodiment of FIG. 5 is that large portions of insulation 44 can be filled into hole 43 after placement in the partial or completed wall.

In FIG. 6 the known procedure of reinforcing masonry walls and resulting structure by using what is known as re-bar is illustrated. The importance of having grip holes 45 in masonry block is clearly shown in this figure. The wall 46 is reinforced by the use of steel rods 47 which are extended down through the aligned grip holes 45 in each block. Prior art insulated blocks without grip holes 45 make it extremely difficult to construct a reinforced wall unless each block has portions knocked away to make room for the reinforcing bars 47. When portions of the block are broken away, the integrity and strength of the block is compromised. The present invention provides blocks with both desirable insulation properties and grip holes so that reinforcing bars may be easily used to build a structurally sound, strong wall.

Thus, the blocks of the present invention used alone or with prior art conventional two hole blocks (or others) may be conveniently reinforced by known procedures as shown in FIG. 6. Also, in a preferred embodiment as shown in FIG. 2, slots 48 are provided in the wall of the end side sections of at least one grip hole to facilitate entrance of re-bars or bars 47 into each grip hole. These slots can be used, if desired, in any embodiment shown in any figure of this disclosure or in any other embodiment of this invention.

The preferred and optimumly preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. A substantially rectangular building block comprising an inside segment, an outside segment and a middle portion, said middle portion having a serpentine-like configuration and positioned between and connecting said outside and inside segments and containing an insulating material throughout substantially its entire area, the area of said inside segment being greater than the area of said outside segment, at least one projection extending inwardly from a first one of said segments and at least one receiving opening in a second segment to receive said projection, an entrance of said receiving opening-having a smaller diameter than the largest diameter of said projection, said building block comprising at least one grip hole to accommodate handling by the builder, all of said projection, receiving opening and grip hole having a substantially rounded form to minimize fracturing of any section of said building block.

2. A substantially rectangular building clock comprising terminal ends, terminal corners, an inside segment, an outside segment and a middle portion, said middle portion having a sinuous and serpentine-like configuration and positioned between and connecting said outside and inside segments and containing an insulating material throughout substantially its entire area, the area of said inside segment being greater than the area of said outside segment, at least one dovetail projection extending inwardly from a first one of said segments and at least one receiving opening in a second segment to receive said projection, an entrance of said receiving opening having a smaller diameter than a largest diameter of said projection, said building block comprising at least one grip hole in said inside segment to accommodate handling by the builder, all of said projections, receiving opening and grip hole having a substantially rounded form to minimize fracturing of any section of said building block.

3. The building block of claim 2 having at least one grip hole positioned in balanced relationship in aid inside segment and at least one slot is provided in a side wall section of each grip hole.

4. The building block of claim 2 wherein one of said segments contains two grip holes.

5. The building block of claim 2 wherein said insulating material extends beyond the adjacent terminal portions of said inside segment and said outside segment.

6. The building block of claim 2 wherein at least two mortar grooves are positioned on terminal ends of said building block.

7. The building block of claim 2 wherein two grip holes are positioned in said inside segment of said building block.

8. The building block of claim 2 wherein said projection extends substantially beyond said entrance of said receiving opening and interlocks therewith.

9. The building block of claim 2 wherein at least four mortar grooves are positioned on each terminal corner of said substantially rectangular building block.

* * * * *